United States Patent [19]

Guttenberger et al.

[11] 4,135,297

[45] Jan. 23, 1979

[54] METHOD FOR THE PRODUCTION OF A COIL BODY WITH CONNECTING PINS INCORPORATED IN THE COURSE OF INJECTION

[75] Inventors: Peter Guttenberger, Munich; Harry Schroeder, Unterhaching, both of Germany

[73] Assignee: Siemens Aktiengesellschaft, Berlin & Munich, Germany

[21] Appl. No.: 779,099

[22] Filed: Mar. 18, 1977

[30] Foreign Application Priority Data

Mar. 24, 1976 [DE] Fed. Rep. of Germany ..... 2612582

[51] Int. Cl.[2] ..... H01H 49/00

[52] U.S. Cl. ..... 29/629; 336/192; 264/274; 29/527.4; 29/527.1

[58] Field of Search ..... 29/629, 630 B, 527.1, 29/527.2, 527.4; 264/274; 336/192

[56] References Cited

U.S. PATENT DOCUMENTS

| | | | |
|---|---|---|---|
| 2,963,678 | 12/1960 | Wolf et al. | 336/192 |
| 3,090,996 | 5/1963 | Reichenbach et al. | 29/527.1 |
| 3,207,832 | 9/1965 | Patti et al. | 264/274 |
| 3,258,728 | 6/1966 | Wiley et al. | 336/192 |
| 3,389,461 | 6/1968 | Hardardt | 29/527.1 |
| 3,445,797 | 5/1969 | Otto | 336/192 |
| 3,574,929 | 4/1971 | Michik | 29/630 B |
| 3,613,223 | 10/1971 | Bush | 29/527.1 |
| 3,875,654 | 4/1975 | Ushijima | 29/527.1 |
| 4,010,435 | 3/1977 | Shigehara | 336/192 |

FOREIGN PATENT DOCUMENTS

| | | | |
|---|---|---|---|
| 42-23682 | 5/1967 | Japan | 29/527.1 |
| 454167 | 9/1936 | United Kingdom | 336/192 |
| 611347 | 10/1948 | United Kingdom | 336/192 |
| 1184185 | 3/1970 | United Kingdom | 336/192 |

*Primary Examiner*—C.W. Lanham
*Assistant Examiner*—Daniel C. Crane
*Attorney, Agent, or Firm*—Hill, Gross, Simpson, Van Santen, Steadman, Chiara & Simpson

[57] ABSTRACT

A method of manufacturing injected-molded coil cores having connecting pins embedded in radially extending thin core flanges wherein the cores are formed in a mold having a parting line in the area of desired placement of the pins, the pins are placed into the mold at the time of mold closure and one of the mold faces is equipped with a projecting striker which engages and bends the pin during mold closure, the mold thereafter being filled with injection material which at least partially surrounds the bent portion of the pin while forming the flange embedding portions of the pin, including the bent portion, in the flange.

3 Claims, 4 Drawing Figures

METHOD FOR THE PRODUCTION OF A COIL BODY WITH CONNECTING PINS INCORPORATED IN THE COURSE OF INJECTION

BACKGROUND OF THE INVENTION

1. Field of the Invention

This invention relates to manufacturing methods and more particularly to methods of manufacturing coil cores with flange-embedded connecting pins.

2. Prior Art

Coil bodies or cores are frequently formed by injection-molding and include central core bodies or winding tubes having axially spaced-apart radially projecting flanges with connection pins embedded in one of the flanges.

Typically, many coil designs, such as for electromagnetic relays and the like, require coil bodies or cores which are specifically designed to provide the greatest possible area for the coil winding while maintaining an overall objective of providing the smallest possible complete coil. In order to achieve such constructions, the coil core must be formed having flanges which have axially thin walls. However, since the flange walls generally have to receive and hold connecting pins to be connected to the ends of the winding, the thin walls present a problem in that it becomes extremely difficult to provide a dimensionally stable flange-pin lock firmly holding the connecting pin in the flange. It is well known that in order to provide a sufficiently stable mechanical lock on a straight piece of wire embedded in an injection molded part, the portion of the wire encased in the injected material must have a certain mimimum length. When the thin material of the flange is such as to prevent this minimum length from being established, the connecting pin must be deformed over a portion of its axial length which is embedded in the flange.

Such deformation of the wire connection pins in injected-molded cores has been used. One method of manufacturing such devices involves the crushing of the wire in the injection mold either through a joggling of the wire by means of movable slide mold members or through the provision of additional, extraneous, bending devices. Such prior art methods involve, on the one hand, an additional bending stage, and on the other hand, an inability to predict the direction the deformation of the wire will undergo. Further, in order for any degree of success to occur, the prior art methods can only be used where the total volume of plastic in the area of the connection pin is such as to guarantee that an adequate mass of injected material will be present on each side of the embedded wire. Thus, such methods are not usable whenever the connecting pin is to be fixed at any spot on the coil flange which is defined by close tolerances and where it cannot be guaranteed that a large plastic mass will be present, such as closely adjacent the peripheral edge of the flange.

It would therefore be an advance in the art to provide a method of embedding connecting pins in thin flange coil cores which increase the reliability of the embedding of the pin while at the same time allowing usage of thin flanges.

SUMMARY OF THE INVENTION

It is thus a principal object of this invention to provide a method for the proper attachment and seating of connecting wire pins in coil cores flanges during the course of injection molding of the core. Further, it is part of the object to insure that the bending of the pin in the embedded area occurs in a manner which assures that the pin will be bent in a given direction thereby allowing the pin to be placed at an optimum position while assuring a stable connection.

These objectives are met by initially positioning the connecting pins between opposed faces of the injection mold along a parting line of the mold and by constructing the mold such that during closure, the pins will be bent by engagement with a striker projection formed as a part of one of the mold members.

In accordance with the method of this invention, it is assured that the connecting pin involved will be bent in a predetermined direction so that an optimum attachment of the connecting pin to the core will be insured even under the most restrictive of dimensional placement conditions. Additionally, it is extremely technically simple to place the method into effect. Further, the method is very economical in that it does not require the use of any additional and separate bending devices, any additional and separate mold slides or parts, or any additional assembly activities.

In a particularly preferred and illustrated embodiment, the connecting pins are embedded in the coil flange during injection-molding of the flange with the pins aligned parallel to the axis of the coil. In this construction, it is expedient if the ends of the connecting pins which extend from the flange toward the coil winding space be bent in a direction which is approximately perpendicular to the coil axis, the bending taking place after injection. By so bending the pins, unimpeded wrapping of the winding wire can thereafter occur. In order to facilitate the bending of the pin outwardly from the coil core, it is preferable to provide a recess in the flange outward of the connecting pin into which the pin may be bent. Where, for reasons of economy of space, it is desired that the connecting pins not extend outwardly beyond the coil flange, the pins can thereafter be bent back into an axis parallel position with the coil after the coil has been wound. In order to allow this to occur, it is necessary that the pins be located radially from the coil core a distance greater than the maximum winding diameter.

In order to maintain the construction of the injection mold as simple as possible while providing for practicing of the invention, the space between the connecting pins is preferably greater than the core winding tube diameter. In this manner, removal of the molded ring from the mold with the pins embedded in place is just as easy as removal of standard coil cores. Additional slide members in the mold are not, therefore, necessitated in the practice of this invention.

Other objects, features and advantages of the invention will be readily apparent from the following description of a preferred embodiment thereof, taken in conjunction with the accompanying drawings, although variations and modifications may be effected without departing from the spirit and scope of the novel concepts of the disclosure and in which:

DESCRIPTION OF THE PREFERRED METHOD

Figure 1:
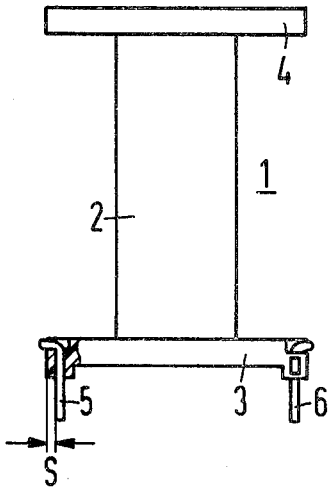
FIG. 1 is a perspective view, partially in section, of a coil core having embedded pins.
Figure 2:
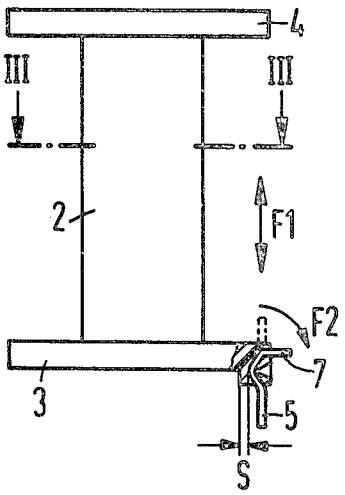
FIG. 2 is a view similar to FIG. 1 illustrating a coil core according to this invention.
Figure 3:
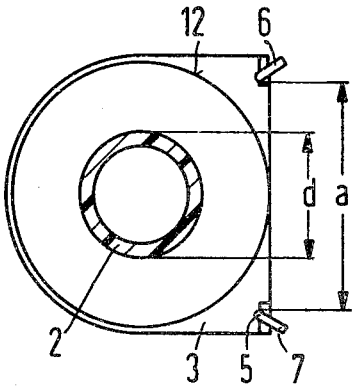
FIG. 3 is a cross-sectional view taken along the lines III—III of FIG. 2.

FIGS. 1 through 3 illustrate coil cores 1 which include a central cylindrical winding tube 2 having flanges 3 and 4 at the axial ends thereof. During injection-molding of the core, connection pins 5 and 6 are embedded in the flange 3 parallel to the axis of the coil. As is known to those practiced in the art, the connecting pins are subjected to various mechanical loads, including a thrust or tensile load along the longitudinal direction of the pin as illustrated by the arrows F1 of FIG. 2. Such loads are encountered, at among other times, during assembly. Further, bending loads, as indicated by the arrow F2 in FIG. 2, also occur, particularly when the pins are bent outwardly to allow opening the space between the flanges completely for winding of the coil on the tube 2. This bending occurs by moving the pin end 7 in an oblique bending movement from the molded-in position illustrated by the broken line of FIG. 2 to the bent position illustrated by the solid line.

In addition to the relative axial thinness of the flanges, it is often desired to place the pins close to the radial periphery or margin of the flange. This results in a very small thickness S of injected-molded material between the pin and the periphery. Because of this, it is necessary to bend the connecting pins to resist the loading forces applied as a F1 and F2. Further, because of the thinness of the material in the area S, it is necessary that the bend imparted to the pin be a bend in a predetermined position or direction.

Figure 4:
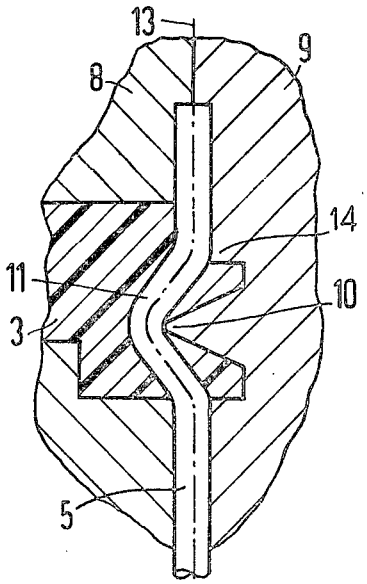
FIG. 4 is a fragmentary greatly enlarged view of the pin-embedding flange portion of the core of FIG. 2 in place in an injection mold as viewed at one point in the practice of the method of this invention.

As discussed above, in order to accomplish this desired and limited bending of the pin during manufacture of the injected-molded coil, the individual pin to be bent, for example, the pin 5 illustrated in FIG. 4, is positioned in the injection mold along an interface or line of separation between mold parts, such as the parts 8 and 9. The mold parts are configured to receive the pin and to firmly hold it when the mold parts are closed. As illustrated, this can be accomplished by mating grooves in the mold parts 8 and 9, which grooves snugly and tightly receive the pin when the mold is closed. One of the mold parts, in the embodiment illustrated, the part 9, is provided with a projection which extends outwardly from the mold part face beyond the center line of the laid-in pin forming a striker 10.

Thus, during closure of the mold parts 8 and 9, the pin 5 will be bent by the striker 10 to form a bend 11 which extends in a given direction predetermined by the projection 10. In the embodiment illustrated, the portion of the mold 9 illustrated forms the periphery of the flange 3 and the projection 10 extends radially toward the body of the core. The pin is aligned in the mold part 8 and is in contact with the mold parts, both above and below the cavity for the flange 3. Thus, during closure, the striker will encounter the pin 11 in an unsupported area of the pin spanning the cavity for the flange. This will cause the pin to bend inwardly toward the main portion of the core. The striker 10 is bordered on either axial side thereof by cavity portions as illustrated. In this manner, when the mold is filled with plastic during the injection process, the pin will be fully embedded in the flange adjacent the periphery since the material will fill the cavity for the flange 3, including the portions of the cavity formed on either axial side of the projection 10. These portions are open to the main cavity for the flange 3. Further, as illustrated, the mold 9 may have a ledge-forming portion 14 which reduces slightly the axial height of the flange periphery outwardly of the pin at the axially inner face of the flange. This provides a step into which the pin may be bent as shown at 7 of FIG. 2. In this manner, the bent pin is fully clear of the winding area. This bending occurs after injection molding when the pin has been firmly seated in the flange.

As illustrated in FIG. 3, the winding of the wire of the coil has a maximum finished diameter as indicated at 12. The flange 3 is designed to have a dimension such that the pins 5 and 6 will be positioned exterior of the diameter 12. This allows the pin ends 7 to be bent back inwardly from the solid line position illustrated in FIG. 2 after the coil has been wound.

Further, in order to allow use of a simple, uncomplex mold, the connecting pins are preferably positioned in such a manner that they are spaced apart a distance which is greater than the diameter of the molded core winding tube d. In this manner, removal of the injected core with the pins embedded from the mold can be simply accomplished with a straight withdrawal. Further, embedding of the pins during molding and the bending of the pins during mold closure is thus possible without the formation of any additional mold parts, such as independently moving slidable mold parts.

Although the teachings of our invention have herein been discussed with reference to specific theories and embodiments, it is to be understood that these are by way of illustration only and that others may wish to utilize our invention in different designs or applications.

We claim as our invention:

1. The method of manufacturing coil cores having a winding tube with axial end flanges which comprises the step of: providing a multi-member injection-molding mold set having opposed faces of at least two members movable together into abutting contact at a parting line, the faces at least partially enclosing the space in which a core flange can be molded with providing a recess in the opposed face of a first one of the member forming a portion of the periphery of the flange space, providing means in at least one of the faces at the parting line for receiving and holding spaced portions of the contact pin on both sides of the flange space with the pins spanning the recess, providing a projecting striker in the recess on the first of the faces adjacent the means, the striker projecting toward the space from the periphery, parting the faces, inserting a pin in the means with a pin portion spanning the flange space and recess closing the faces and thereby gripping the pin between the faces, contacting the pin portion with the striker during closure, laterally bending the portion of the pin at least partially inwardly into the space during closing by contact with the striker terminating the bending with the bent portion lying entirely interior of the space, the striker projecting from a portion of the periphery of the space which defines a periphery of the flange therafter filling the space and recess with injection-molding material forming a core, the material surrounding at least portions of the bent pin and partially embedding the pin, including the bent portion within the material in a flange of the core with remaining portions of the pin projecting from the flange.

2. The method of claim 1 wherein two spaced-apart means are provided, two spaced-apart strikers are provided aligned with the spaced-apart means, two pins are inserted, one in each means, with each pin being bent by contact with its associated striker during closure, and both pins are embedded in a flange during filling.

3. The method of claim 2 wherein the pins are spaced apart a distance greater than the diameter of the winding tube.

* * * * *